United States Patent [19]

Wilson

[11] 4,205,748

[45] Jun. 3, 1980

[54] TWO-PIECE FOLDABLE BASKET CARRIER AND BLANK FOR FORMING THE SAME

[75] Inventor: Jerry F. Wilson, West Monroe, La.

[73] Assignee: Johns-Manville Corporation, Denver, Colo.

[21] Appl. No.: 28,769

[22] Filed: Apr. 10, 1979

[51] Int. Cl.[2] ..... B65D 5/46; B65D 5/48

[52] U.S. Cl. ..... 206/174; 206/179; 206/188; 206/191; 229/28 BC; 229/52 BC

[58] Field of Search ..... 206/174, 186, 188, 191, 206/189, 178, 179; 229/52 BC, 28 BC

[56] References Cited

U.S. PATENT DOCUMENTS

| | | | |
|---|---|---|---|
| 2,687,232 | 8/1954 | Arneson | 229/52 BC |
| 2,755,963 | 7/1956 | Ringler | 229/28 BC |
| 3,166,213 | 1/1965 | Holmes | 229/28 BC |
| 3,402,872 | 9/1968 | Forrer | 229/28 BC |
| 3,572,544 | 3/1971 | Forrer | 229/52 BC |
| 3,754,680 | 8/1973 | Wood | 229/52 BC |
| 4,117,925 | 10/1978 | Wood | 229/52 BC |
| 4,144,966 | 3/1979 | Kulig | 229/52 BC |

*Primary Examiner*—William T. Dixson, Jr.
*Attorney, Agent, or Firm*—Robert M. Krone; Joseph J. Kelly; Norvell E. Von Behren

[57] ABSTRACT

A foldable basket carrier has front and rear panel assemblies hinged about common edges of center panels wherein one of the cutter panels has transverse dividers cut therefrom for one of the front and rear compartments and the other compartment is divided by transverse divider panels on a separate piece.

9 Claims, 6 Drawing Figures

16
18
20
22
24
26
28
30
32
34
36
38
40
42
44
46
48
50
52
54
56
58
60
62
64
66
68
70
72
74
76
78
80
82
84
86
88
90
92
94
96
98
100
102
104
106
108
110
112
114
116
118
128
130
132
134
136
138
140
142
144
146
148
150
152
154
156
158
160
162
164
166
168
170
172

TWO-PIECE FOLDABLE BASKET CARRIER AND BLANK FOR FORMING THE SAME

TECHNICAL FIELD

The present invention relates to foldable basket carriers formed from paperboard material for carrying pluralities of articles such as eight bottles.

BACKGROUND ART

The prior art, as exemplified in U.S. Pat. Nos. 2,755,963, 3,065,876, 3,125,243, 3,166,213, 3,402,872, 3,610,511, 3,722,737, 3,784,053 and 4,117,925, contains a number of basket-type article carriers, some of which are foldable. Generally, the prior art basket carriers have one or more deficiencies, such as (1) having insufficient strength to prevent tearing when handling a large number of articles such as eight bottles, (2) requiring extra assembly and folding steps, (3) utilizing extra quantities of paper board in manufacture, etc.

SUMMARY OF THE INVENTION

The invention is summarized in a foldable basket carrier including first and second pieces wherein the first piece includes front and rear first center panels hinged together at top edges thereof, front and rear second center panels hinged together at top edges thereof, one of the rear center panels having a plurality of transverse partitions hinged at inner edges of the transverse partitions on the one center panel, another of the center panels extending substantially the full length and height of the carrier to form a full center divider for the carrier, all of the center panels having upper portions with finger openings therein and being secured to each other to form a center support and handle, front and rear left side panels hingedly joined at inner edges thereof to left edges of the respective front and rear first center panels, front and rear right side panels hingedly joined at inner edges thereof to right edges of the respective front and rear second center panels, front and rear wall panels hingedly joined at the left and right edges thereof to outer edges of the respective front and rear side panels of the left and right side panels, the plurality of transverse partitions of the one center panel each having a tab secured to the inside surface of the rear wall panel, front and rear bottom panel means hingedly joined together at inner edges thereof and hingedly joined at outer edges thereof to bottom edges of the respective front and rear wall penels; and wherein the second piece includes a support portion secured to the front surface of the center support, a plurality of transverse partition panels hinged at inner edges thereof to the support portion, and a plurality of tabs hinged on the outer edges of the corresponding transverse partition panels and secured to the inside surface of the front wall.

An object of the invention is to construct a foldable, durable basket carrier from paperboard with a substantially solid construction.

Another object of the invention is to construct a full protection basket carrier with a strong handle.

It is also an object of the invention to design a carrier blank to form a durable basket carrier with a minimum of paper board.

Additional features of the invention include the provision of a full center keel for separating the articles in front compartments from articles in rear compartments in the carrier; and the provision of a handle structure having six plies of paperboard to form a relatively rigid strong handle; and/or the provision of one set of partitions for the front of the container cut from integral center panels thereof and the provision of a separate piece including partitions for the rear of the container which are installed in a flat unfolded condition and maintained in this state when the carrier is in a collapsed or folded condition.

Other objects, advantages and features of the invention will be apparent from the following description of the preferred embodiment taken in conjunction with the accompanying drawings.

DESCRIPTION OF THE PREFERRED EMBODIMENT

Figure 1:
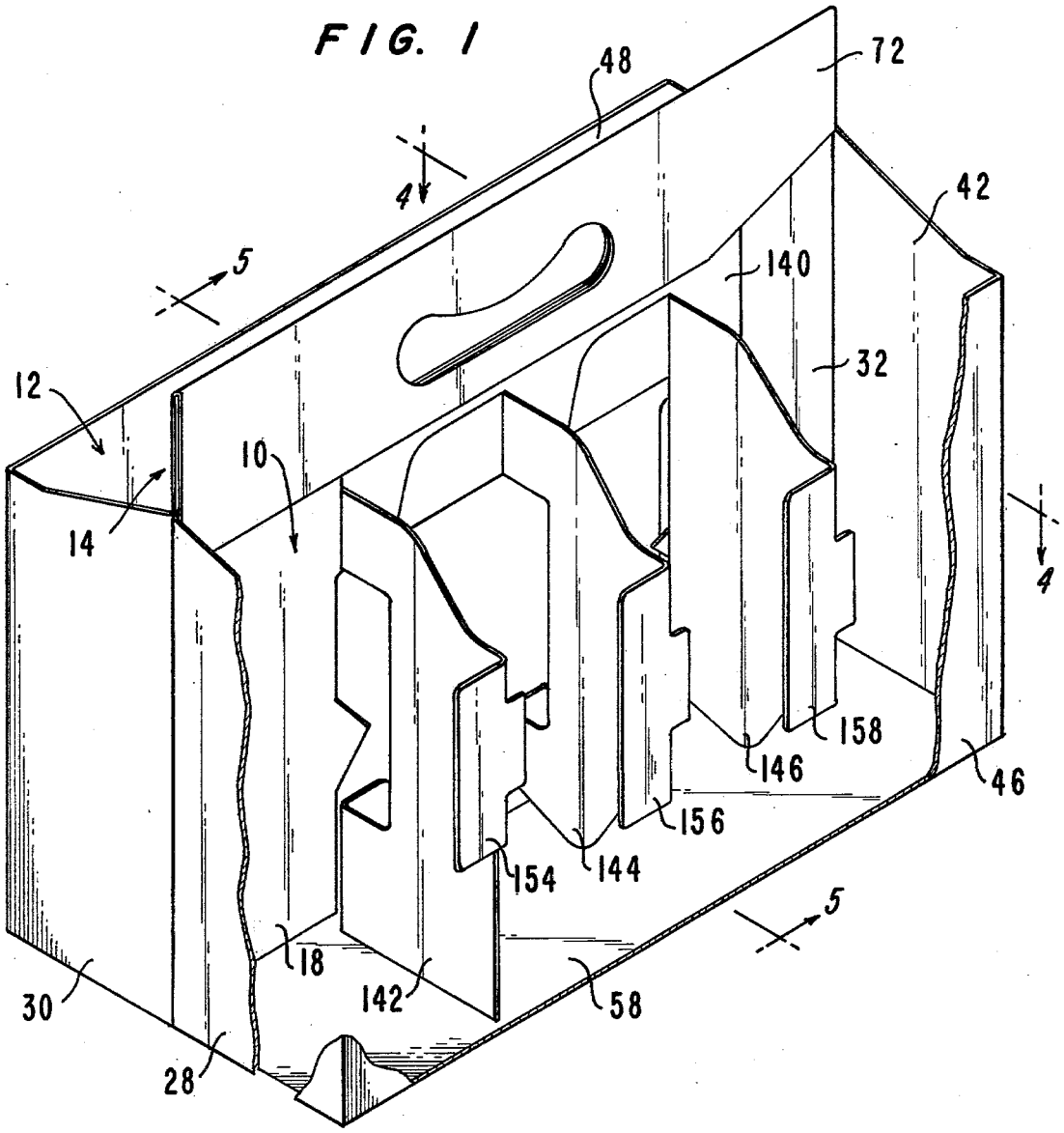
FIG. 1 is a perspective view, with portions broken away, of a foldable basket carrier in accordance with the invention.
Figures 2, 3:
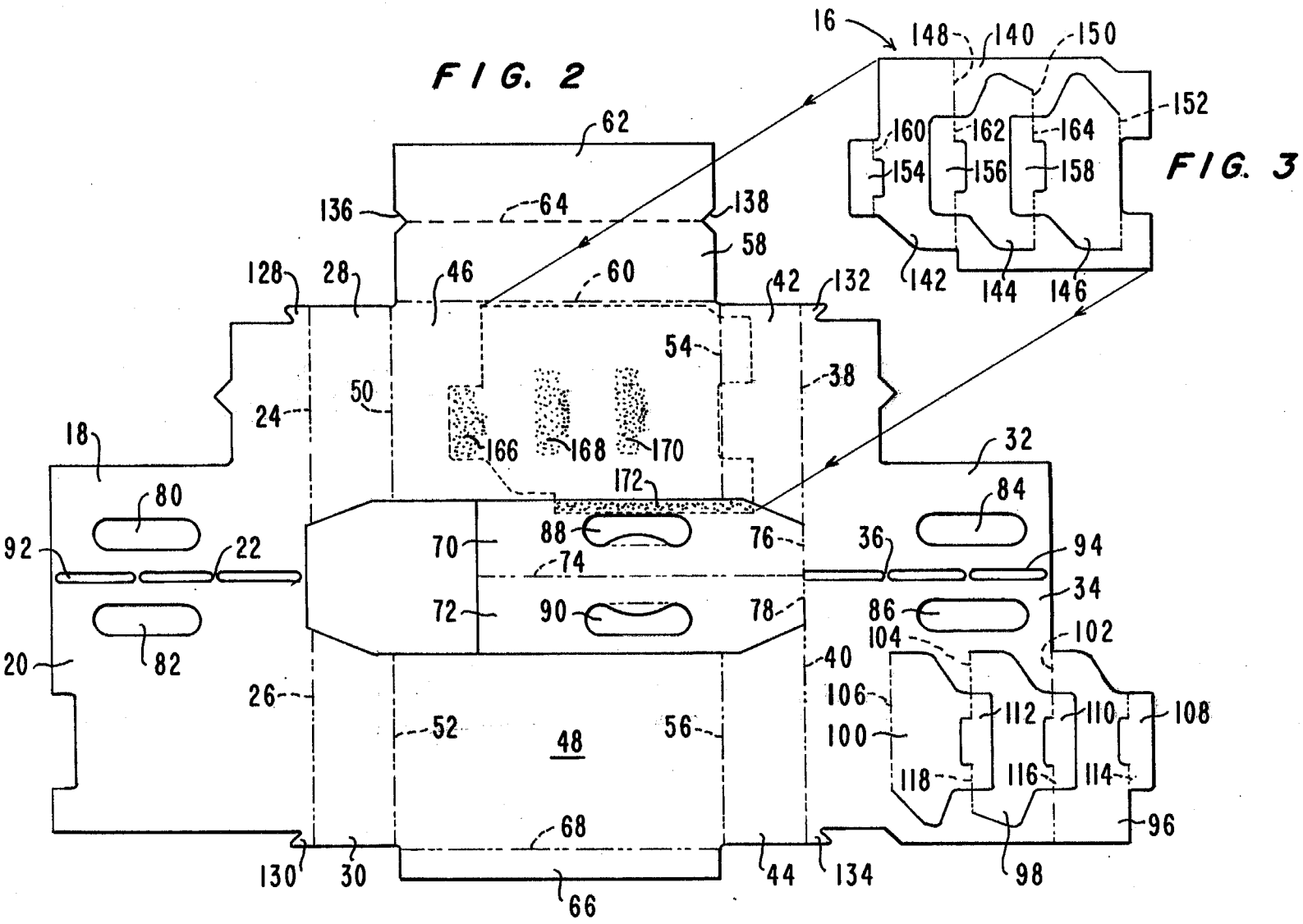
FIG. 2 is a plan view of a blank cut to form one piece of the carrier of FIG. 1.
FIG. 3 is a plan view of a blank cut to form a second piece of the carrier of FIG. 1.
Figure 4:
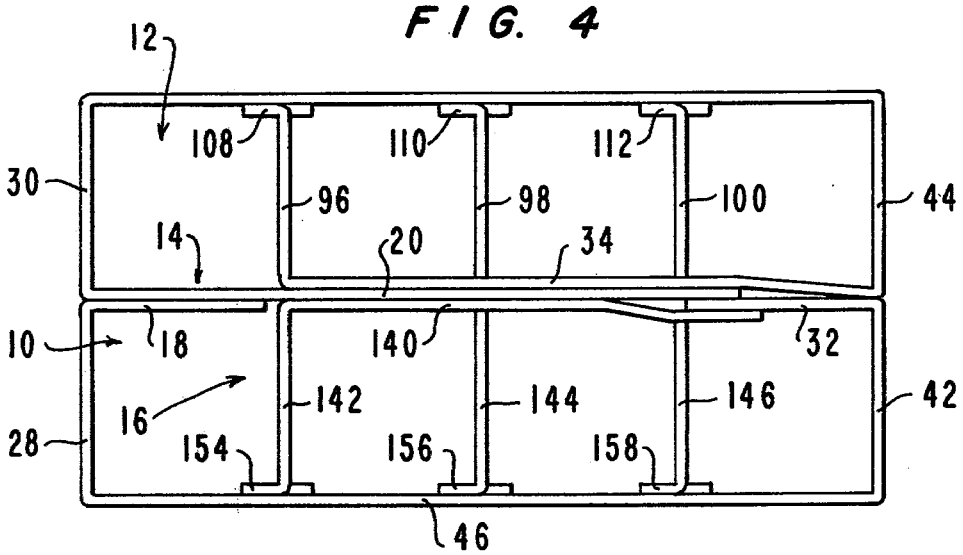
FIG. 4 is a horizontal cross-section view taken at line 4—4 in FIG. 1.

As illustrated in FIG. 1, the invention is embodied in a foldable carrier having front and rear compartments indicated generally at 10 and 12, respectively, which are open at the top and separated by a center keel indicated generally at 14 with an upper handle portion. This center keel together with the outer walls and bottom of the carrier as well as transverse partitions in the rear compartment 12 (see FIG. 4) are formed from a cut blank or piece illustrated in FIG. 2. A separate piece or blank illustrated generally at 16 in FIGS. 3 and 4 is assembled with the blank of FIG. 2 to form transverse divider partitions in the front compartment 10. The transverse partitions in the front and rear compartments form four cells in each of these compartments to thus form eight cells in the carrier for receiving articles such as bottles.

The blank of FIG. 2 includes front and rear inner center panels 18 and 20 which are hinged together at their inner edges (upper edges as viewed in the assembled and open carrier of FIG. 1) along a score line 22 and are hinged at their right edges (left edges in FIG. 1) at respective score lines 24 and 26 to left edges (inner edges in FIG. 1) of front and rear left side panels 28 and 30. Front and rear outer center panels 32 and 34, at the opposite end of the blank, are hinged together at their inner edges (top edges in FIG. 1) at a score line 36 and are hinged at their left edges (right edges in FIG. 1) on score lines 38 and 40 to right edges (inner edges in FIG. 1) of respective front and rear right side panels 42 and 44. Front and rear wall panels 46 and 48 are hinged on their left edges at score lines 50 and 52 to right edges (outer edges in FIG. 1) of the front and rear left side panels 28 and 30, and are hinged on their right edges at score lines 54 and 56 to left edges (outer edges in FIG. 1) of the respective front and rear right side panels 42 and 44. Front bottom panel 58 is hinged at its outer edge along score line 60 to the outer edge (bottom edge in FIG. 1) of front wall panel 46. Rear bottom panel 62 is hinged at its inner edge along score line 64 to the inner edge of the front bottom panel 58. Bottom glue flap 66 is hinged at score line 68 on the outer edge (bottom edge in FIG. 1) of the rear wall panel 48 for overlapping and being secured to the outer edge portion of the rear bottom panel 62. Front and rear outer handle panels 70 and 72 are hinged together at their inner edges (top edges in FIG. 1) along score line 74 and are hinged at their right edges to upper portions of the left edges (right edges in FIG. 1) of the respective front and rear outer center panels 32 and 34 at respective score lines 76 and 78.

The upper portions of the center panels 18, 20, 32 and 34 are designed to extend above the remaining portions of the carrier and have respective finger openings 80, 82, 84 and 86 formed therein. Finger openings 88 and 90 are also formed in the outer handle panels 70 and 72. Portions of the joined edges of the panels 18 and 20 are cut away to form elongated openings 92 along the score line 22, and portions of the joined edges of the panels 32 and 34 are cut away to form elongated openings 94 along the score line 36; these elongated openings 92 and 94 are selected to permit easy folding of the upper handle portions of panels 18, 20, 32 and 34 when they are all joined together with the outer handle panels 70 and 72.

Transverse divider panels 96, 98 and 100 are cut from and hinged to the outer rear center panel 34 along respective score lines 102, 104 and 106 at inner edges of the transverse panels 96, 98 and 100. Tabs 108, 110 and 112 are hinged to the outer edges of the respective transverse partition panels 96, 98 and 100 at score lines 114, 116 and 118. The inner rear center panel 20 is designed to overlap the center panel 34 and be secured thereto to cover the openings formed by the transverse divider panels 96 and 98 and thus form with the panel 34 a full center member extending substantially the full width and height of the carrier.

Figure 6:
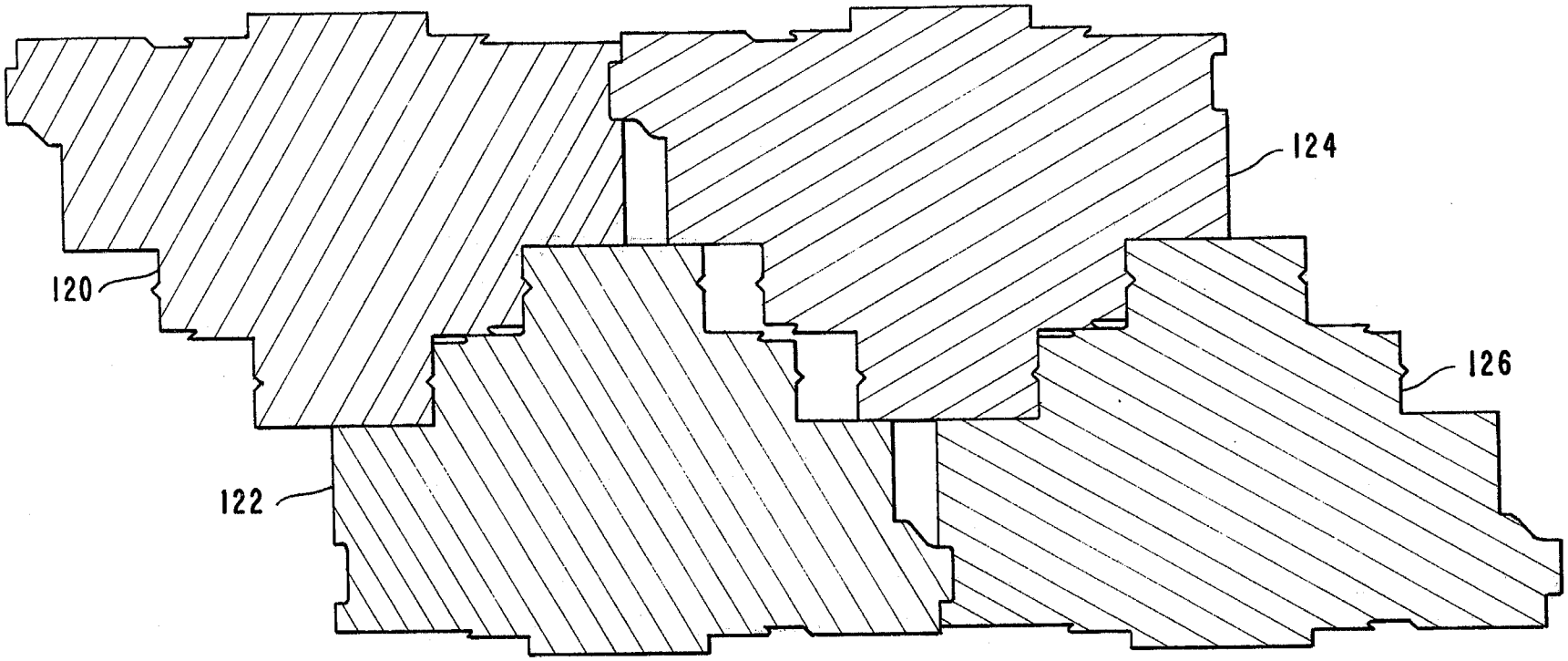
FIG. 6 is a plan view of a nesting arrangement of four of the blanks of FIG. 2 used in cutting such blanks from paperboard stock.

The front center panels 18 and 32 are formed without any respective left and right outer portions (right and left lower portions in FIG. 1) to form a deep nest feature of the carrier as shown in FIG. 6. Two blanks 120 and 122 (both identical to the blank of FIG. 2 with one blank being rotated 180 degrees) can be cut by a single die from a paperboard stock. A succeeding pair of blanks 124 and 126, closely spaced to the position from which the blanks 120 and 122 have been cut, can be subsequently cut by the die. This deep nest feature produces substantially less waste and uses substantially less paperboard material to produce a low cost carrier.

Additionally there are formed inward extending hooks 128 and 130 on the outer right corners (bottom left corners as viewed in FIG. 1) of the respective panels 18 and 20. Similar hooks 132 and 134 are formed on the outer left corners (bottom right corners as viewed in FIG. 1) of the center panels 32 and 34. Notches 136 and 138 are formed in the respective left and right edges of the bottom panels 58 and 62 at the center hinge line 64 therebetween for cooperating with the hooks 128, 130, 132 and 134 to permit the hooks to be inserted below the center of the joined bottom panels 58 and 62 to aid in supporting the bottom panels.

Referring to FIG. 3, the divider 16 has a support portion 140 with three transverse divider panels 142, 144 and 146 hinged at inner edges thereof to the support portion 140 at respective score lines 148, 150 and 152. Glue tabs 154, 156 and 158 are hinged at respective score lines 160, 162 and 164 on the outer edges of the respective transverse divider panels 142, 144 and 146.

In assembly of the blanks of FIGS. 2 and 3 to form the carrier of FIG. 1, glue is applied to the inside surface of the front wall panel 46 at spots 166, 168 and 170 and glue is applied to the inside surface of the front outside panel 70 at the lower edge thereof at spot 172. The panel 16 is laid over the panel of FIG. 2 as illustrated by the dashed line securing the tabs 154, 156 and 158 to the inside surface of the front wall panel 46 at the spots 166, 168 and 170 and securing the support portion 140 at its lower edge (upper edge in FIG. 1) to the inside surface of outer portion (lower portion in FIG. 1) of the front outside handle panel 70 at spot 172. The outer center panels 32 and 34 are folded about the score lines 38 and 40. The panel 32 is secured by gluing to the inside surfaces of the handle panel 70 and the inside surfaces of the support portion 140 of the divider 16. The tabs 108, 110 and 112 are glued to the inside surface of the rear wall panel 48 while the upper handle portion of the panel 34 is glued to the inside surface of the upper handle panel 72. The inner center panels 18 and 20 together with the left side panels 28 and 30 are folded about the score lines 50 and 52. The center panel 18 is glued to exposed portions of the support portion 140 and the handle panel 70 as well as a portion of the inside surface of the upper portion of panel 32. The panel 20 is glued to exposed surface portions of the handle panel 72 and to inside surface portions of the panel 34 excluding the divider panels 96, 98 and 100 with their tabs 108, 110 and 112. The rear bottom panel 62 is folded about the score line 64 over the front bottom panel 58. The entire front portion of the carrier is folded about the score lines 22, 36 and 74. Inside surfaces of the panel 20 are glued to the inside surfaces of the panel 18 as well as inside exposed surfaces of the support portion 140 of the divider 16. Exposed portions of the inside surface of the panel 32 are also glued to exposed inside surface portions of the panel 34. The outer edge portion of the panel 62 is glued to the glue flap 66. The carrier may then be opened in a conventional manner to the condition of FIG. 1 to receive bottles in the cells in the front and rear compartments 10 and 12.

Figure 5:
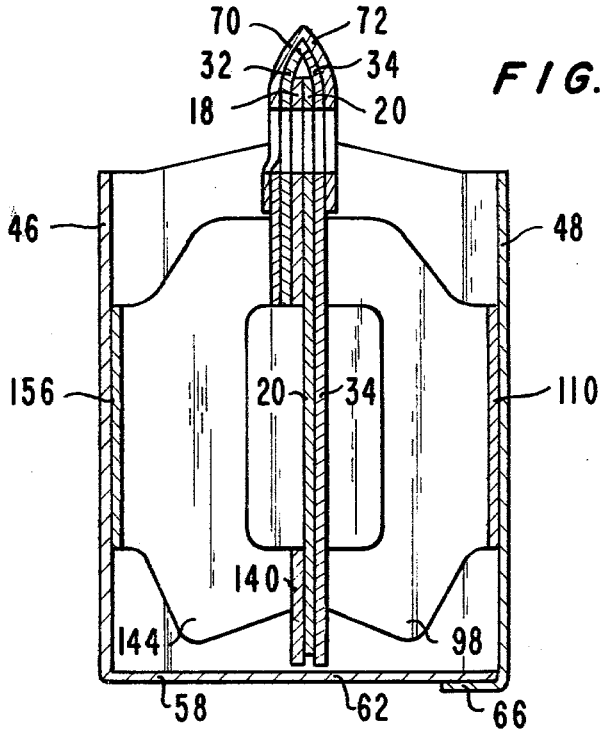
FIG. 5 is a vertical cross-section view taken at line 5—5 in FIG. 1.

The present basket carrier has a substantially more solid construction resulting in a more durable carrier than basket carriers of the same type in the prior art. The center panel 20 in combination with the overlapping and secured portion of the center panel 34 forms a full center support or keel as shown in FIGS. 4 and 5 extending substantially the entire length and height of the carrier. This fully center keel, in addition to providing full separation of articles in the front compartment 10 from articles in the rear compartment 12, provides a strong support for the walls, the transverse partition panels, and the bottom of the carrier. Additionally, the combination of the upper portions of the center panels 18, 20, 32 and 34 with the outside handle panels 70 and 72 secured together with the finger openings 80, 82, 84, 86, 88 and 90 all aligned results in a six-ply handle structure which substantially reduces tearing of the handle portion of the carrier occurring particularly when the carrier is used for large numbers of articles such as eight bottles. This durable carrier is produced by a unique blank structure permitting the deep nest feature described above and shown in FIG. 6.

It is noted that the divider 16 is assembled in the flat or unfolded condition as shown in FIG. 3 and remains in this flat condition while the carrier is in a folded condition, i.e., the transverse panels remain in the plane of divider. Having the divider 16 in an unfolded condition eliminates one or more folding steps for the divider in the assembly operation and maintains maximum strength of the hinge joints in the divider by avoiding bending during assembly.

Since the present invention is subject to many modifications, variations and changes in detail, it is intended that all matter described above and shown in the accompanying drawings be interpreted as illustrative and not in a limiting sense.

What is claimed is:

1. A foldable basket carrier comprising first and second pieces wherein said first piece includes front and rear first center panels hinged together at top edges thereof, front and rear second center panels hinged together at top edges thereof, one of said rear center panels having a plurality of transverse partitions hinged at inner edges of the transverse partitions on the one center panel, another of said center panels being secured to said one center panel to form therewith a center member extending substantially the full length and height of the carrier to form a full center divider for the carrier, all of said center panels having upper portions with finger openings therein and being secured to each other to form a center support and handle, front and rear left side panels hingedly joined at inner edges thereof to left edges of the respective front and rear first center panels, front and rear right side panels hingedly joined at inner edges thereof to right edges of the respective front and rear second center panels, front and rear wall panels hingedly joined at the left and right edges thereof to outer edges of the respective front and rear side panels of the right and left side panels, said plurality of transverse partitions of the one center panel each having a tab secured to the inside surface of the rear wall panel, front and rear bottom panel means hingedly joined together at inner edges thereof and hingedly joined at outer edges thereof to bottom edges of the respective front and rear wall panels; and wherein said second piece includes a support portion secured to a front surface of the center support, a plurality of transverse partition panels hinged at inner edges thereof to the support portion, and a plurality of tabs hinged on the outer edges of the corresponding transverse partition panels and secured to an inside surface of the front wall panel.

2. A foldable basket carrier as claimed in claim 1 wherein said another center panel is the other of said rear center panels, and said front center panels are formed only with upper portions and one side portions so as to permit deep nesting during the cutting of the panels from a paper stock material.

3. A foldable basket carrier as claimed in claim 1 wherein the plurality of transverse partition panels on said one center panel comprise three transverse partition panels and wherein said plurality of transverse partition panels of said second piece comprise three transverse partition panels to form an eight-cell basket carrier.

4. A foldable basket carrier as claimed in claim 1, 2 or 3 including front and rear handle panels having respective finger openings and being secured to the outer surfaces of the center support and handle with the finger openings formed in the handle panels aligned with the finger openings of the center support to form a six-ply handle for the carrier.

5. A foldable basket carrier as claimed in claim 1, 2 or 3 including front and rear handle panels secured to outer surfaces of the center support and having finger openings therethrough aligned with the finger openings through the center support wherein the front and rear handle panels are hinged together at their top edges and are hinged to upper portions of outer edges of the respective front and rear second center panels.

6. A blank for forming a foldable basket carrier comprising first and second pieces wherein said first piece includes front and rear first center panels hinged together at inner edges thereof, front and rear second center panels hinged together at inner edges thereof, one of said rear center panels having a plurality of transverse partitions hinged at one edges of the transverse partitions on the one center panel, another of said center panels being securable to said one center panel for forming therewith a center member extending substantially the full length and height of the carrier for forming a full center divider for the carrier, all of said center panels being securable to each other and having upper portions with finger openings therein for forming a center support and handle, front and rear left side panels hingedly joined at left edges thereof to right edges of the respective front and rear first center panels, front and rear side panels hingedly joined at right edges thereof to left edges of the respective front and rear second center panels, front and rear wall panels hingedly joined at the left and right edges thereof to right and left edges of the respective front and rear side panels of the right and left side panels, said plurality of transverse partitions of the one center panel each having a tab for being secured to the inside surface of the rear wall panel, front and rear bottom panels hingedly joined together at inner edges thereof, said front bottom panel hingedly joined at an outer edge thereof to an outer edge of the front wall panel, a glue flap hinged on an outer edge of the rear wall panel for being secured to an outer edge portion of the rear bottom panel; and wherein said second piece includes a support portion for being secured to a front surface of the center support, a plurality of transverse partition panels hinged at one edges thereof to the support portion, and a plurality of tabs hinged on the outer edges of the corresponding transverse partition panels and secured to an inside surface of the front wall panel.

7. A blank for a carrier as claimed in claim 6 wherein said another center panel is the other of said rear center panels, and said front center panels are formed only with inner portions adjacent the rear center panels and the respective front left and right side panels so as to permit deep nesting during the cutting of the panels from a paper stock material.

8. A blank for a carrier as claimed in claim 6 wherein the plurality of transverse partition panels on said one center panel comprise three transverse partition panels and wherein said plurality of transverse partition panels of said second piece comprise three transverse partition panels for forming an eight-cell carrier.

9. A blank for a carrier as claimed in claim 6, 7 or 8 including front and rear handle panels for being secured to outer surfaces of the center support and having finger openings therethrough for being aligned with the finger openings through the center support wherein the front and rear handle panels are hinged together at their inner edges and are hinged to inner portions of inner edges of the respective front and rear second center panels.

* * * * *

UNITED STATES PATENT AND TRADEMARK OFFICE

CERTIFICATE OF CORRECTION

PATENT NO. : 4,205,748

DATED : June 3, 1980

INVENTOR(S) : Jerry F. Wilson

It is certified that error appears in the above—identified patent and that said Letters Patent is hereby corrected as shown below:

In the Abstract, 3rd Line, 5th word, "cutter" should read -- center --.

Column 1, line 49, "penels" should read -- panels --.

Column 4, line 7, before the word "panel" insert the word -- handle --.

Column 4, line 51, "fully" should read -- full --.

Column 6, line 38, "rear side panels" should read -- rear right side panels --.

Column 7, line 8, "eight-cell carrier" should read -- eight-cell basket carrier --.

Signed and Sealed this

Sixth Day of January 1981

[SEAL]

Attest:

SIDNEY A. DIAMOND

Attesting Officer

Commissioner of Patents and Trademar